US011584497B2

(12) United States Patent
Nanjo

(10) Patent No.: US 11,584,497 B2
(45) Date of Patent: Feb. 21, 2023

(54) OUTBOARD MOTOR

(71) Applicant: YAMAHA HATSUDOKI KABUSHIKI KAISHA, Iwata (JP)

(72) Inventor: Morihiko Nanjo, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 112 days.

(21) Appl. No.: 17/245,089

(22) Filed: Apr. 30, 2021

(65) Prior Publication Data

US 2022/0017200 A1 Jan. 20, 2022

(30) Foreign Application Priority Data

Jul. 16, 2020 (JP) ..... JP2020-121891

(51) Int. Cl.
*B63H 20/10* (2006.01)
*B63H 20/06* (2006.01)

(52) U.S. Cl.
CPC ..... *B63H 20/10* (2013.01); *B63H 20/06* (2013.01)

(58) Field of Classification Search
CPC ..... B63H 20/10; B63H 20/06
See application file for complete search history.

(56) References Cited

U.S. PATENT DOCUMENTS 2,953,335 A 9/1960 Kiekhaefer
5,006,083 A 4/1991 Sumigawa
6,165,032 A 12/2000 Nakamura
6,220,905 B1 4/2001 Blanchard
6,325,686 B1 * 12/2001 Funami ..... B63H 20/10 440/61 R
8,814,614 B2 8/2014 Suzuki et al.
2002/0031959 A1 3/2002 Sadakata

FOREIGN PATENT DOCUMENTS

JP 01-317893 A 12/1989

OTHER PUBLICATIONS

Official Communication issued in corresponding European U.S. Appl. No. 21/167,623 4, dated Sep. 23, 2021.

* cited by examiner

*Primary Examiner* — Stephen P Avila
(74) *Attorney, Agent, or Firm* — Keating and Bennett, LLP

(57) ABSTRACT

An outboard motor includes an outboard motor body that, when located in a full trim-in position, an upper connecting pin is located in a lower limit position below a tilt shaft. When the outboard motor body is in a full tilt-up position, the upper connecting pin is located in the upper limit position above the tilt shaft. The upper connecting pin rotates around the tilt shaft at a first rotation angle from the lower limit position to a horizontal position at the same height as the tilt shaft. The upper connecting pin rotates at a second rotation angle around the tilt shaft from the horizontal position to the upper limit position. The second rotation angle is larger than the first rotation angle.

9 Claims, 9 Drawing Sheets

OUTBOARD MOTOR

CROSS REFERENCE TO RELATED APPLICATIONS

This application claims the benefit of priority to Japanese Patent Application No. 2020-121891 filed on Jul. 16, 2020. The entire contents of this application are hereby incorporated herein by reference.

BACKGROUND OF THE INVENTION

1. Field of the Invention

The present invention relates to an outboard motor.

2. Description of the Related Art

An outboard motor includes a bracket and an outboard motor body. The outboard motor body is attached to a boat via a bracket. For example, as disclosed in Japan Patent Laid-open Patent Publication JP-A-1-317893, the bracket rotatably supports the outboard motor body via a tilt shaft. A tilt cylinder is connected to the outboard motor body. The tilt cylinder expands and contracts to rotate the outboard motor body around the tilt shaft. The outboard motor body moves between a full trim-in position and a full tilt-up position by rotating around the tilt shaft. The full trim-in position is a position of the outboard motor body when the lower end of the outboard motor body is closest to a stern of the boat. The full tilt-up position is a position of the outboard motor body when the lower end of the outboard motor body is farthest from the stern of the boat. The outboard motor body is pulled up most upward at the full tilt-up position.

SUMMARY OF THE INVENTION

When a boat is moored, an outboard motor body is held in a full tilt-up position. In order to prevent the outboard motor body from being eroded by water, it is desirable to hold the outboard motor body as high as possible away from the water surface. Preferred embodiments of the present invention provide outboard motors each of which is able to hold the outboard motor body as high as possible away from the water surface in the full tilt-up position.

An outboard motor according to a preferred embodiment of the present invention includes a bracket, an outboard motor body, a tilt shaft, a tilt cylinder, a lower connecting pin, and an upper connecting pin. The bracket is attached to the boat. The outboard motor body is supported by the bracket. The tilt shaft rotatably connects the outboard motor body to the bracket. The tilt cylinder includes an upper connector and a lower connector. The tilt cylinder expands and contracts to rotate the outboard motor body around the tilt shaft between the full tilt-up position and the full trim-in position. The lower connecting pin connects the lower connector to the bracket. The upper connecting pin connects the upper connector to the outboard motor body.

When the outboard motor body is located in the full trim-in position, the upper connecting pin is located in a lower limit position below the tilt shaft. When the outboard motor body is in the full tilt-up position, the upper connecting pin is located in an upper limit position above the tilt shaft. The upper connecting pin rotates around the tilt shaft at a first rotation angle from the lower limit position to a horizontal position at the same height as the tilt shaft. The upper connecting pin rotates at a second rotation angle around the tilt shaft from the horizontal position to the upper limit position. The second rotation angle is larger than the first rotation angle.

In an outboard motor according to a preferred embodiment of the present invention, the upper connecting pin rotates from the lower limit position to the horizontal position at the first rotation angle around the tilt shaft. The upper connecting pin rotates at the second rotation angle around the tilt shaft from the horizontal position to the upper limit position. The second rotation angle is larger than the first rotation angle. Therefore, a rotation range from the horizontal position to the upper limit position is larger than a rotation range from the lower limit position to the horizontal position. Therefore, the outboard motor body is substantially tilted up. As a result, the outboard motor body is able to be held at a high position far away from the water surface in the full tilt-up position.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
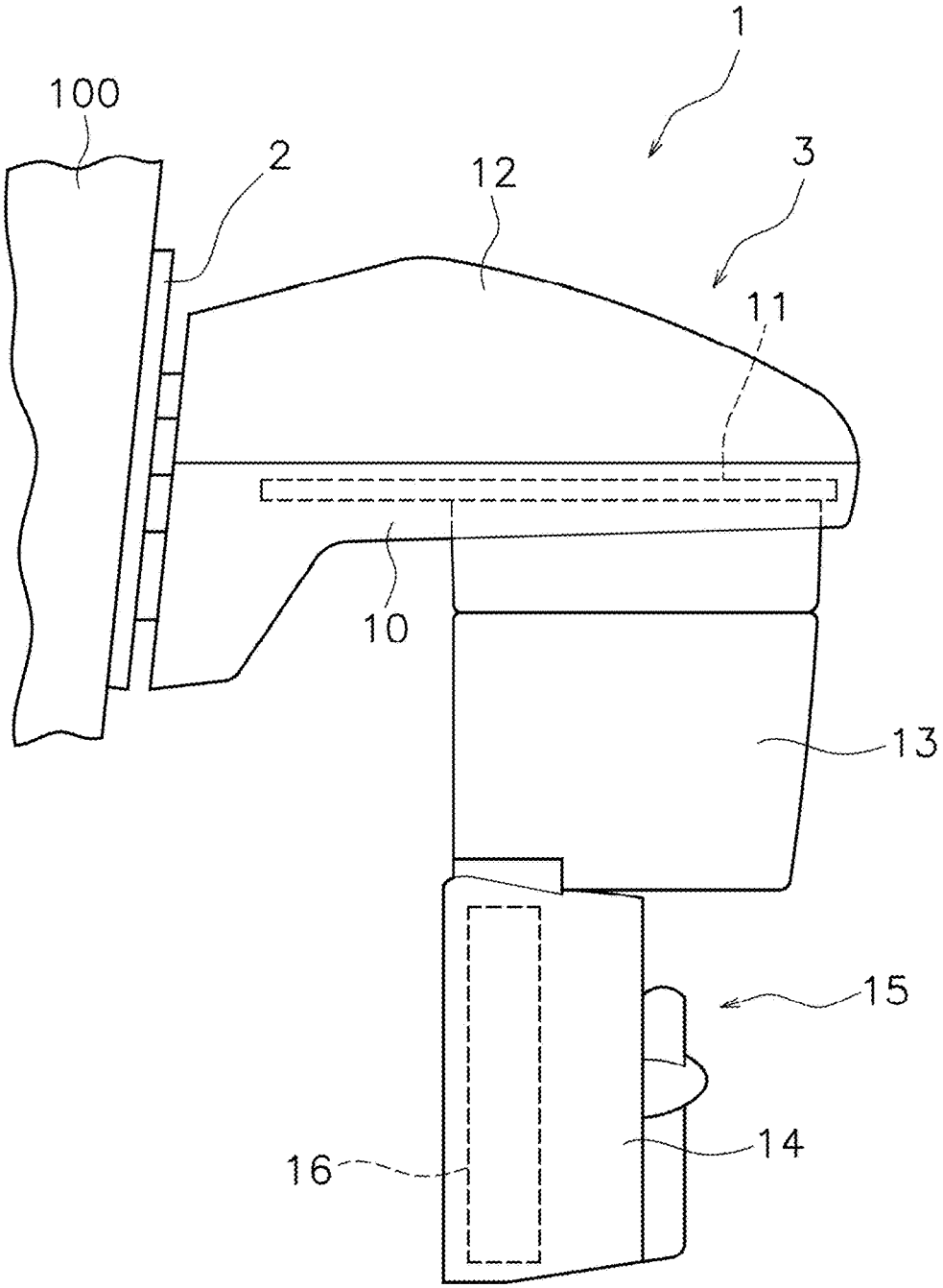
FIG. 1 is a side view of an outboard motor according to a preferred embodiment of the present invention.
Figure 2:
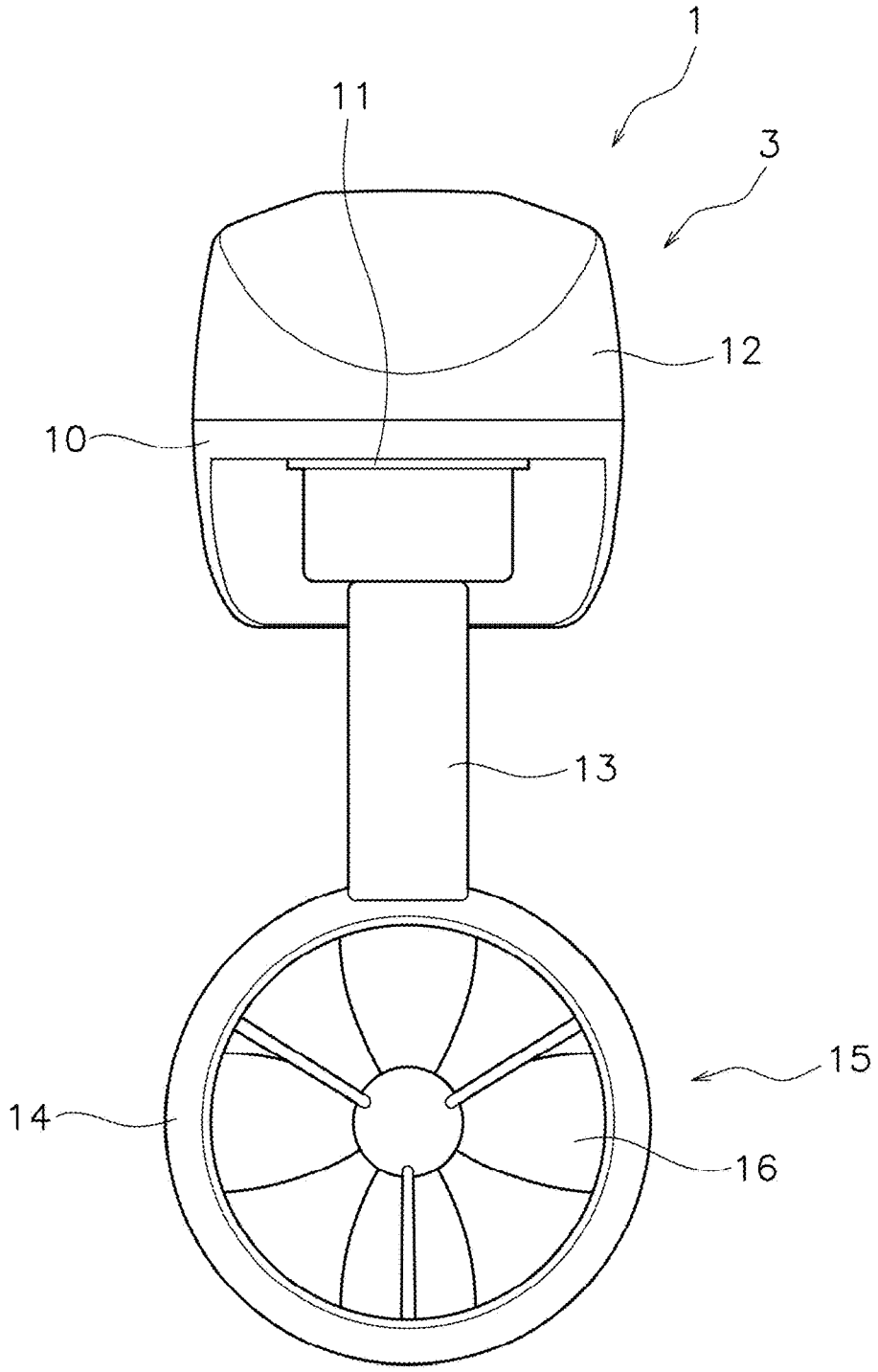
FIG. 2 is a rear view of the outboard motor.

Hereinafter, outboard motors according to preferred embodiments of the present invention will be described with reference to the drawings. FIG. 1 is a side view of the outboard motor 1 according to a preferred embodiment of the present invention. FIG. 2 is a rear view of the outboard motor 1. As illustrated in FIG. 1, the outboard motor 1 is attached to a stern of a boat 100. The outboard motor 1 includes a bracket 2 and an outboard motor body 3. The bracket 2 is attached to the boat 100. The outboard motor 1 is attached to the boat 100 via the bracket 2. The outboard motor body 3 is supported by the bracket 2.

The outboard motor body 3 includes a cover 10, a base 11, a cowl 12, an upper housing 13, a lower housing 14, and a drive unit 15. The cover 10 is attached to the base 11. The base 11 is connected to the bracket 2. The cowl 12 is located above the base 11. The cowl 12 is attached to the base 11. The upper housing 13 is located below the base 11. The upper housing 13 extends downward from the base 11. The lower housing 14 is located below the upper housing 13. The drive unit 15 is located in the lower housing 14.

Figure 3:
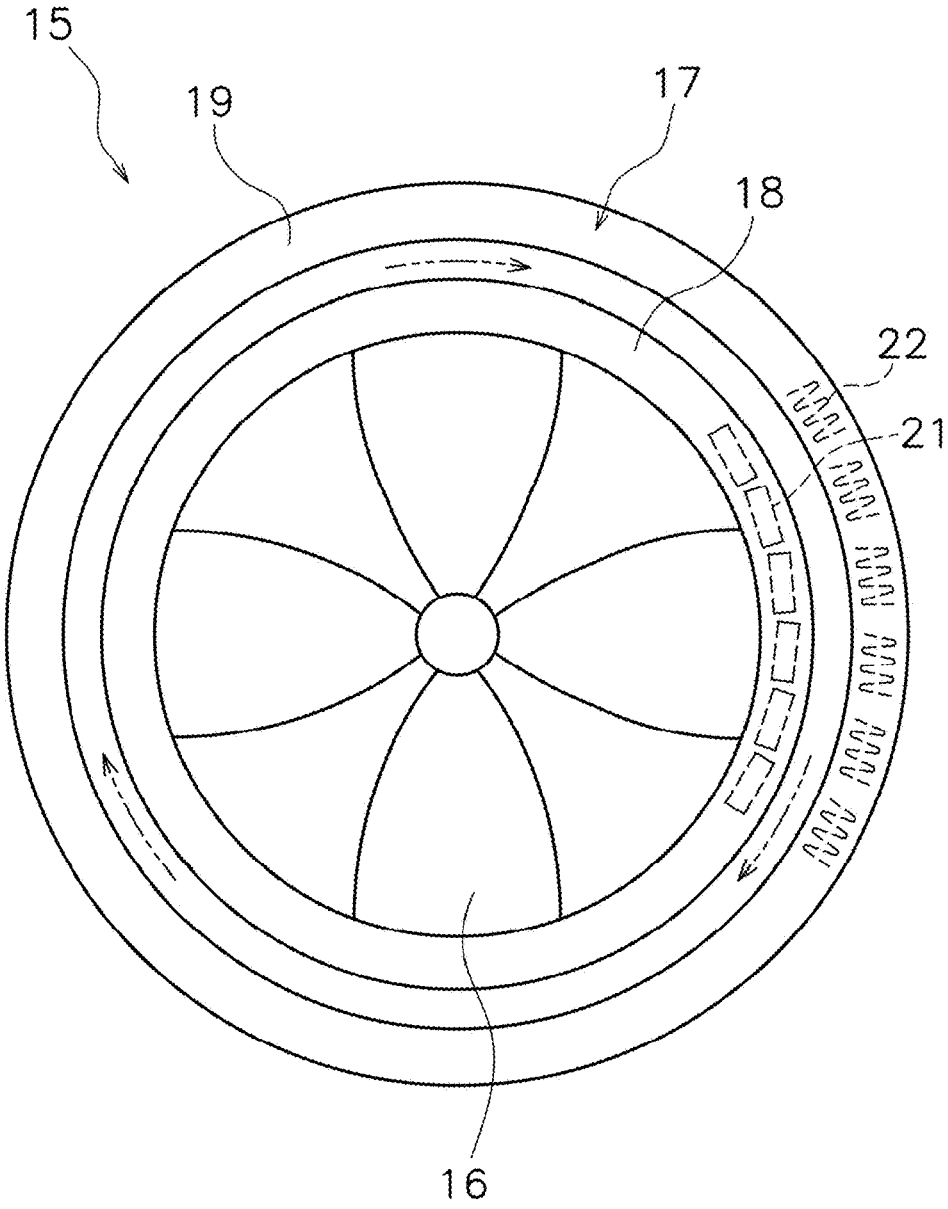
FIG. 3 is a schematic view showing a configuration of a drive unit.

The drive unit 15 generates thrust to propel the boat 100. FIG. 3 is a schematic view showing the configuration of the drive unit 15. As illustrated in FIG. 3, the drive unit 15 includes a propeller 16 and an electric motor 17. The electric motor 17 rotates the propeller 16. The outboard motor 1 generates the propulsive force of the boat 100 by rotating the propeller 16 with the electric motor 17. The electric motor 17 includes a rotor 18 and a stator 19. The rotor 18 and the stator 19 each have a tubular shape. The rotor 18 is located radially inward of the stator 19. The rotor 18 is rotatably supported by the lower housing 14. The rotor 18 rotates with respect to the stator 19. The propeller 16 is located radially inward of the rotor 18. The propeller 16 is fixed to the rotor 18. The propeller 16 rotates together with the rotor 18. The rotor 18 includes a plurality of permanent magnets 21. The plurality of permanent magnets 21 are located along the circumferential direction of the rotor 18. In FIG. 3, reference numeral 21 indicates only one of the plurality of permanent magnets 21, and the reference numerals of the other permanent magnets 21 are omitted.

The stator 19 is located radially outward of the rotor 18. The stator 19 is fixed to the lower housing 14. The stator 19 includes a plurality of coils 22. The plurality of coils 22 are located along the circumferential direction of the stator 19. By energizing the plurality of coils 22, an electromagnetic force that rotates the rotor 18 is generated. In FIG. 3, reference numeral 22 indicates only one of the plurality of coils 22, and the reference numerals of the other coils 22 are omitted.

Figure 4:
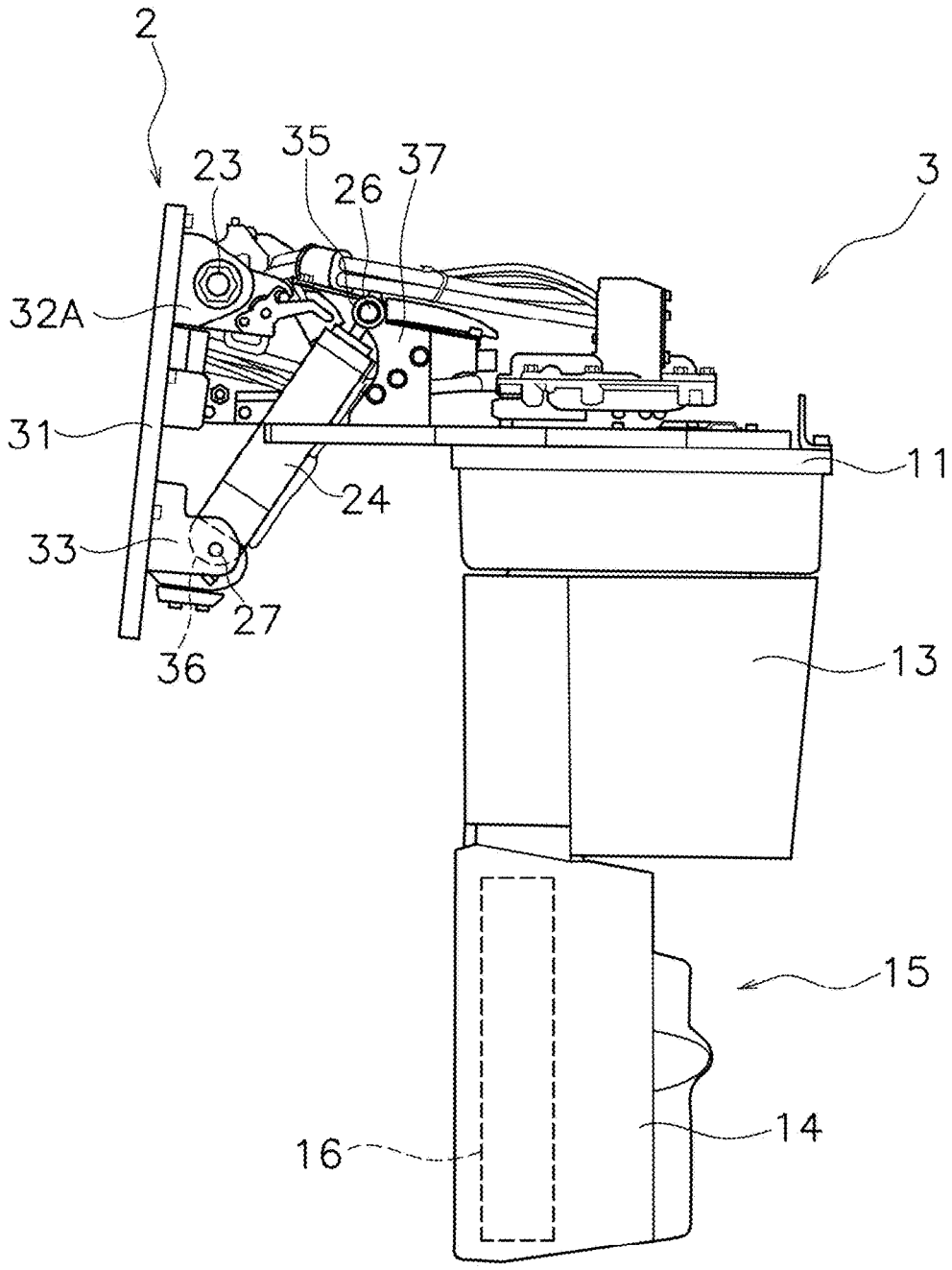
FIG. 4 is a side view of the outboard motor from which a cowl has been removed.
Figure 5:
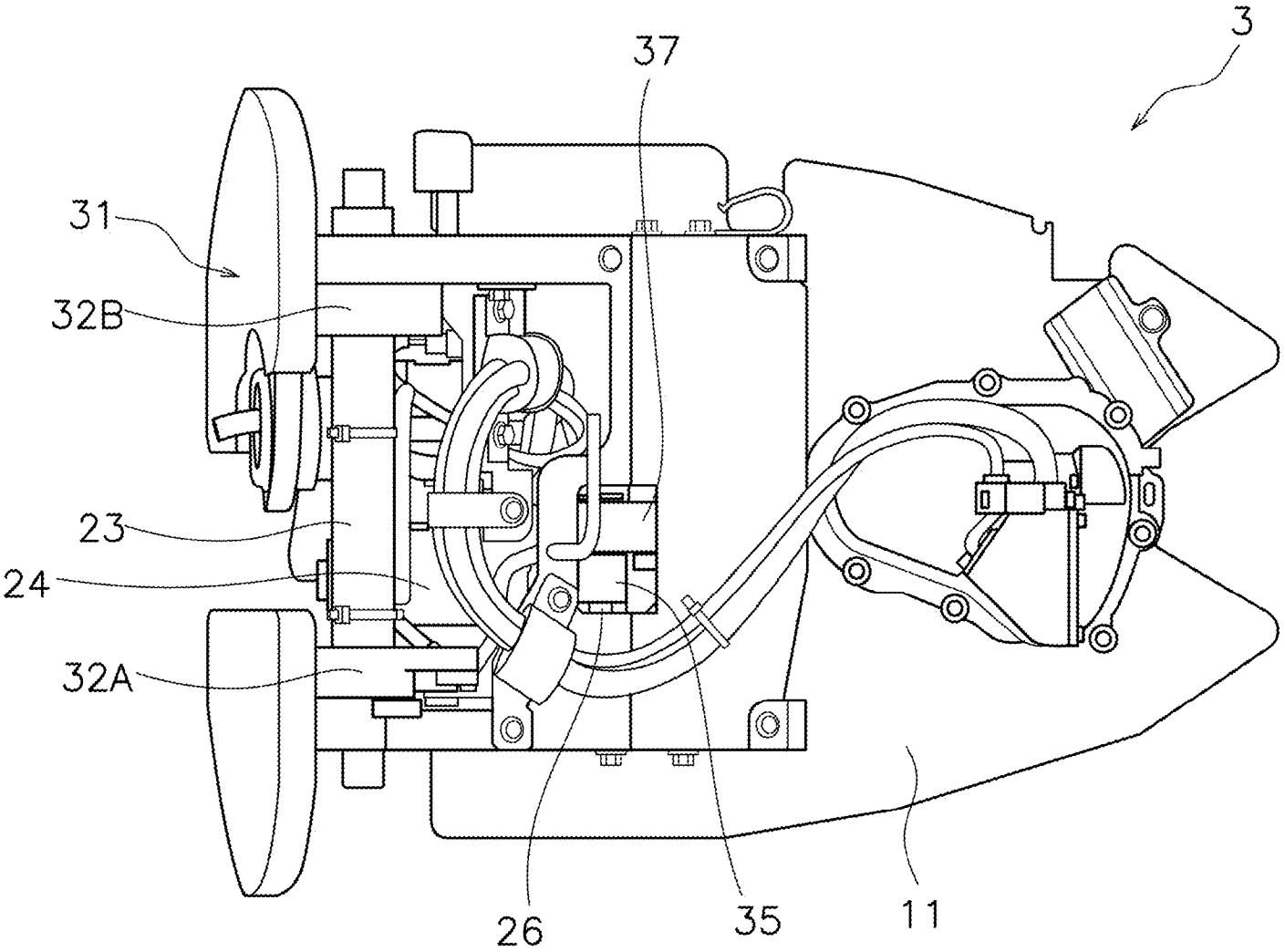
FIG. 5 is a top view of the outboard motor from which the cowl has been removed.

FIG. 4 is a side view of the outboard motor 1 from which the cowl 12 has been removed. FIG. 5 is a top view of the outboard motor 1 from which the cowl 12 has been removed. As illustrated in FIGS. 4 and 5, the outboard motor 1 includes a tilt shaft 23, a tilt cylinder 24, an upper connecting pin 26, and a lower connecting pin 27. The tilt shaft 23 is supported by the bracket 2. The tilt shaft 23 rotatably connects the outboard motor body 3 to the bracket 2. The tilt shaft 23 extends in the left-right direction of the outboard motor 1. The tilt shaft 23 is located in the cowl 12.

The bracket 2 includes a bracket body 31, upper supports 32A and 32B, and a lower support 33. The bracket body 31 is attached to the boat 100. The bracket body 31 has a plate shape. The upper supports 32A and 32B and the lower support 33 project from the bracket body 31. The tilt shaft 23 is connected to the upper supports 32A and 32B. The lower support 33 is located below the upper supports 32A and 32B. The tilt cylinder 24 is connected to the lower support 33.

The tilt cylinder 24 is located in the cowl 12. The tilt cylinder 24 is a hydraulic cylinder, for example. A hydraulic pump and a motor to drive the hydraulic pump are integrated in the tilt cylinder 24. However, the hydraulic pump and the motor may be separate from the tilt cylinder 24.

The tilt cylinder 24 includes an upper connector 35 and a lower connector 36. The upper connector 35 is located at one end of the tilt cylinder 24. The lower connector 36 is located at the other end of the tilt cylinder 24. The upper connector 35 is connected to the outboard motor body 3 by the upper connecting pin 26. Specifically, the outboard motor body 3 includes a cylinder connector 37. The cylinder connector 37 is supported by the base 11. The cylinder connector 37 projects upward from the base 11. The upper connector 35 is connected to the cylinder connector 37. The lower connector 36 is connected to the bracket 2 by the lower connecting pin 27. Specifically, the lower connector 36 is connected to the lower support 33.

Figure 6:
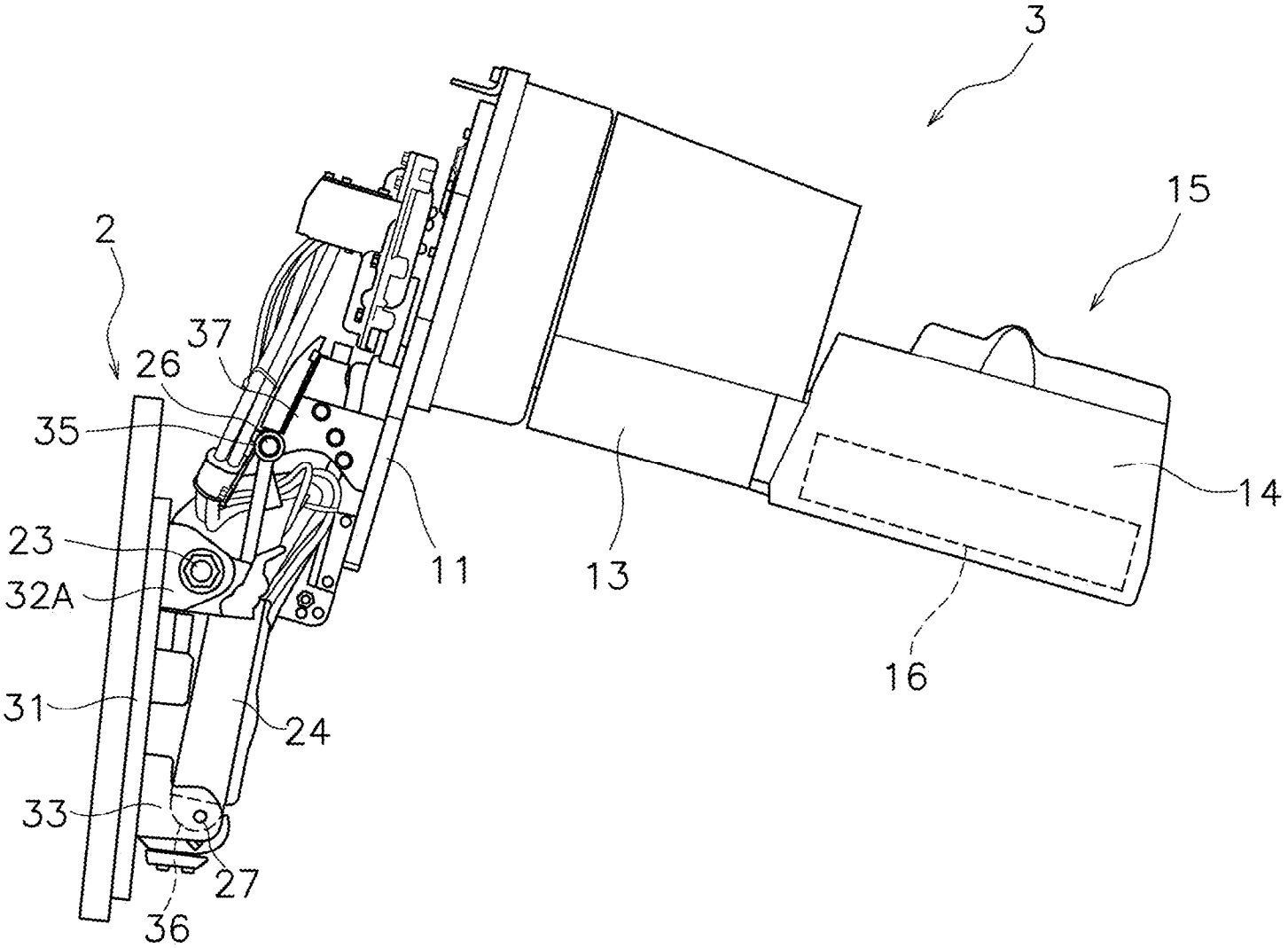
FIG. 6 is a side view showing the outboard motor at a full tilt-up position.

The tilt cylinder 24 expands and contracts to rotate the outboard motor body 3 around the tilt shaft 23 between a full tilt-up position and a full trim-in position. FIG. 4 shows the outboard motor 1 at the full trim-in position. FIG. 6 shows the outboard motor 1 in the full tilt-up position. As illustrated in FIG. 4, in the full trim-in position, the propeller 16 is located below the lower connecting pin 27. As illustrated in FIG. 6, in the full tilt-up position, the propeller 16 is located above the lower connecting pin 27.

Figure 7:
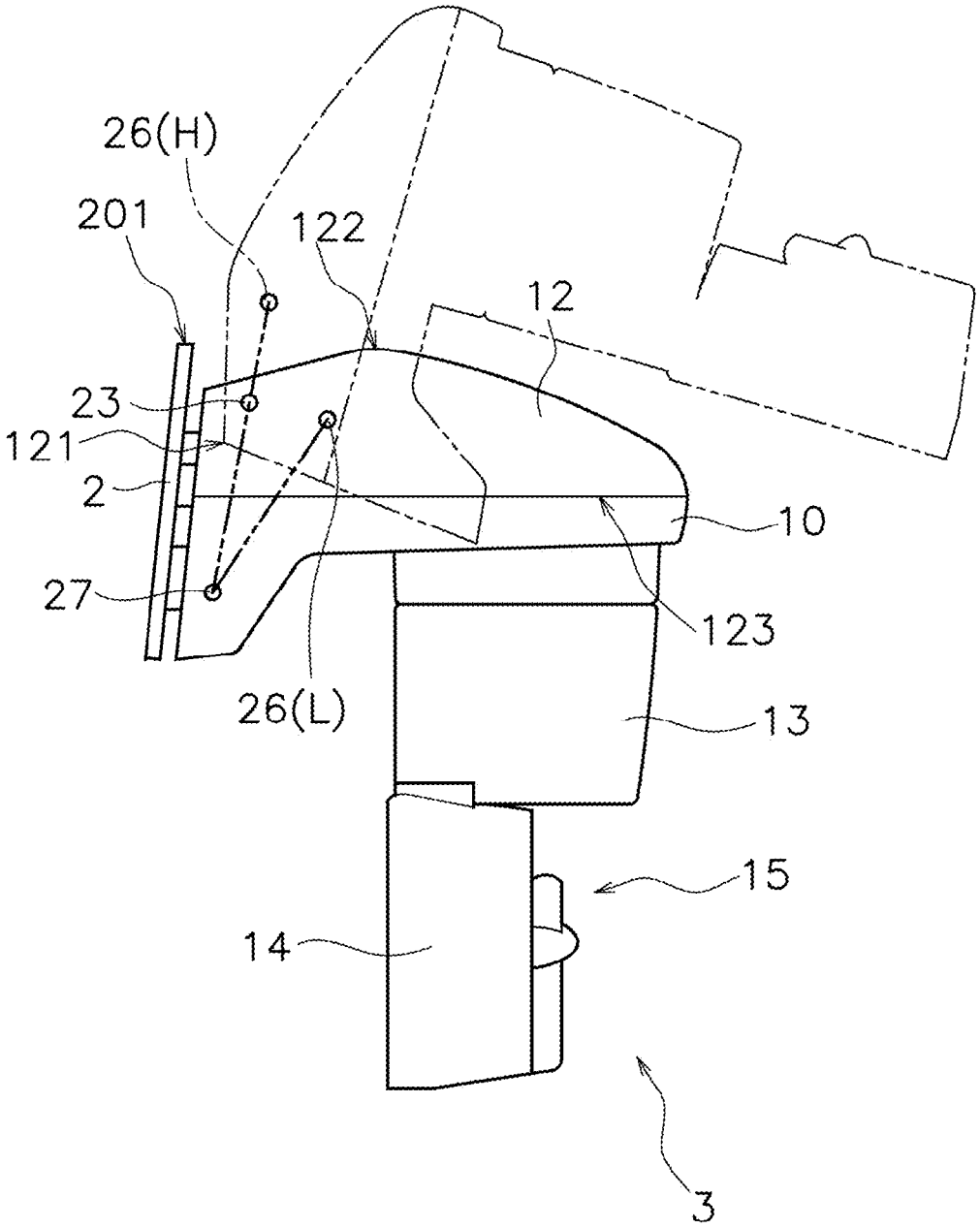
FIG. 7 is a side view of the outboard motor showing positions of an upper connecting pin, a lower connecting pin, and a tilt shaft.
Figure 8:
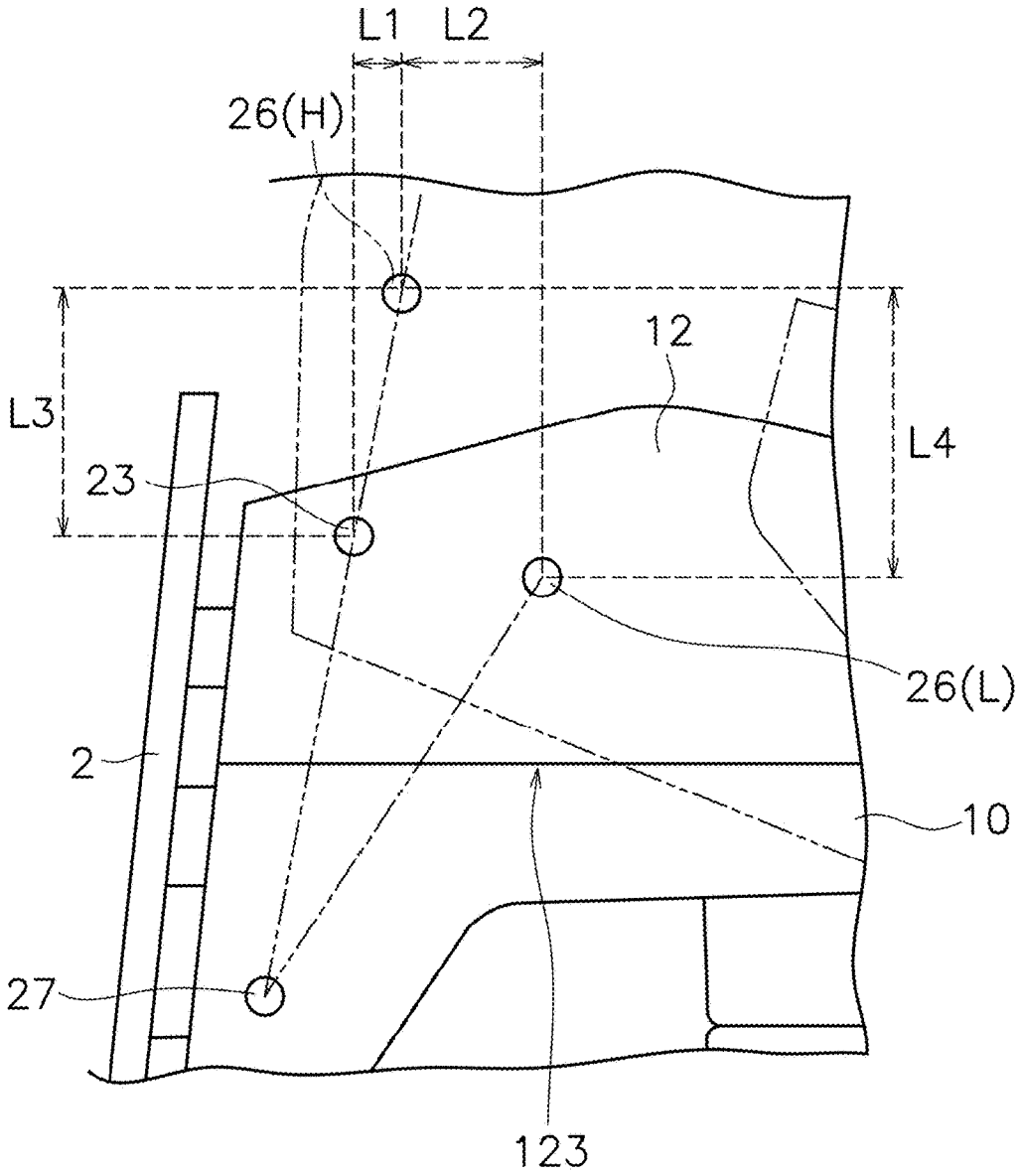
FIG. 8 is an enlarged view showing the positions of the upper connecting pin, the lower connecting pin, and the tilt shaft.
Figure 9:
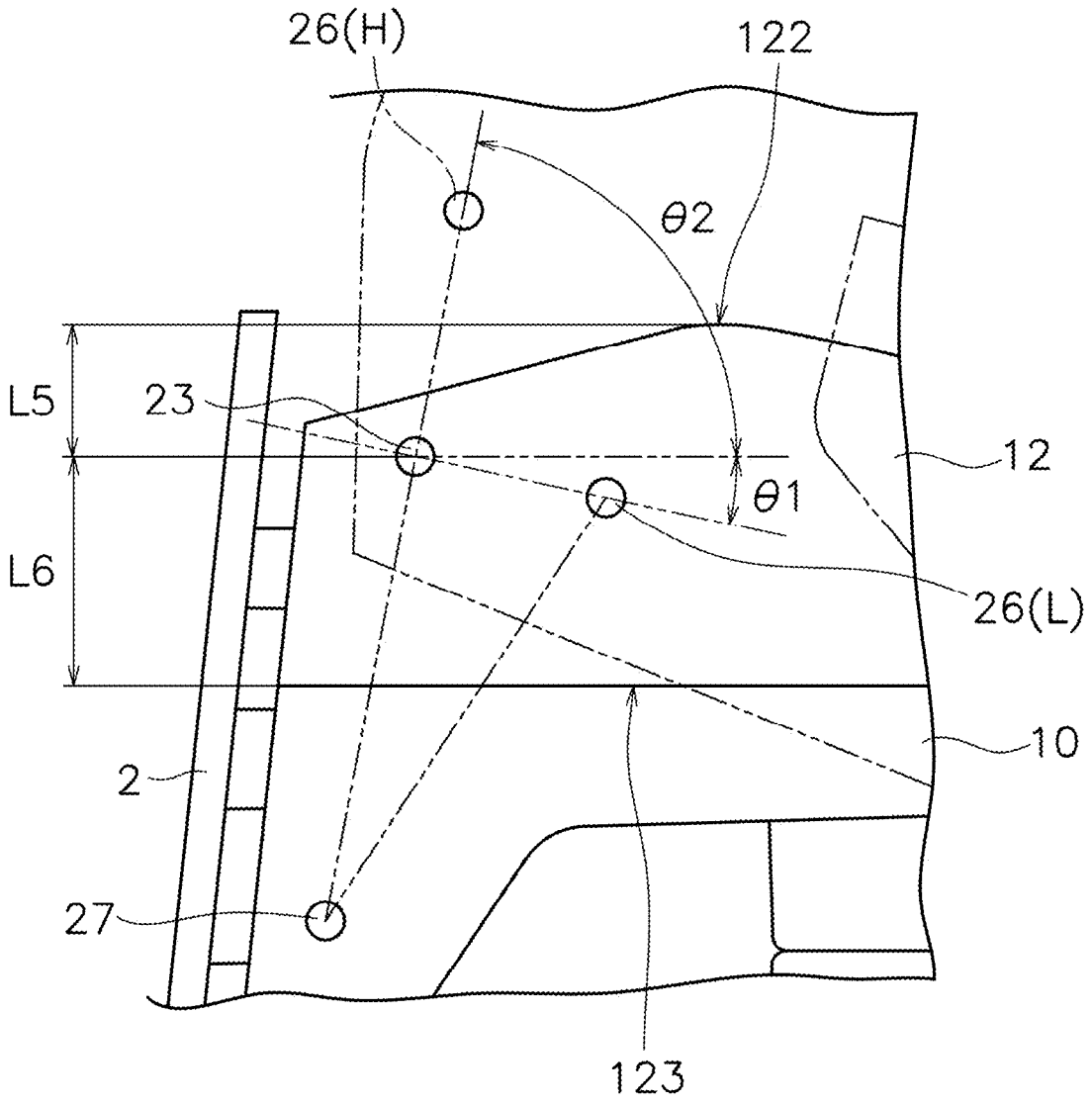
FIG. 9 is an enlarged view showing the positions of the upper connecting pin, the lower connecting pin, and the tilt shaft.

FIG. 7 is a side view of the outboard motor 1 showing the positions of the upper connecting pin 26, the lower connecting pin 27, and the tilt shaft 23. FIGS. 8 and 9 are enlarged views showing the positions of the upper connecting pin 26, the lower connecting pin 27, and the tilt shaft 23. The upper connecting pin 26 moves according to the operation of the outboard motor body 3 around the tilt shaft 23. The lower connecting pin 27 and the tilt shaft 23 do not move regardless of the operation around the tilt shaft 23 of the outboard motor body 3. In addition, in FIG. 7 and FIG. 8, the solid line shows the outboard motor body 3 located at the full trim-in position. The two-dot chain line indicates the outboard motor body 3 located at the full tilt-up position.

As illustrated in FIGS. 7 and 8, when the outboard motor body 3 is located at the full trim-in position, the upper connecting pin 26 is located at the lower limit position (L) below the tilt shaft 23. When the outboard motor body 3 is in the full tilt-up position, the upper connecting pin 26 is located at the upper limit position 26 (H) above the tilt shaft 23. The upper limit position 26 (H) is located forward of the lower limit position 26 (L). The upper limit position (H) is located rearward of the tilt shaft 23. As illustrated in FIG. 8, in the horizontal direction, a distance L1 between the tilt shaft 23 and the upper limit position 26 (H) is less than a distance L2 between the upper limit position 26 (H) and the lower limit position 26 (L). However, in the horizontal direction, the distance L1 between the tilt shaft 23 and the upper limit position 26 (H) may be equal to or greater than the distance L2 between the upper limit position 26 (H) and the lower limit position 26 (L). In the vertical direction, a distance L3 between the tilt shaft 23 and the upper limit position 26 (H) is less than a distance L4 between the upper limit position 26 (H) and the lower limit position 26 (L).

As illustrated in FIG. 9, the upper connecting pin 26 rotates around the tilt shaft 23 at a first rotation angle θ1 from the lower limit position 26 (L) to a horizontal position at the same height as the tilt shaft 23. The upper connecting pin 26 rotates around the tilt shaft 23 at a second rotation angle θ2 from the horizontal position to the upper limit position 26 (H). That is, the first rotation angle θ1 is an angle with respect to the horizontal direction of a straight line passing through the upper connecting pin 26 and the tilt shaft 23 when the outboard motor body 3 is located at the full trim-in position. The second rotation angle θ2 is an angle with respect to the horizontal direction of the straight line passing through the upper connecting pin 26 and the tilt shaft 23 when the outboard motor body 3 is located at the full tilt-up position. The second rotation angle θ2 is larger than the first rotation angle θ1. For example, the second rotation angle θ2 may be larger than about 5 times the first rotation angle θ1. The second rotation angle θ2 may be larger than about 6 times the first rotation angle θ1, for example.

As illustrated in FIG. 7, when the outboard motor body 3 is located at the full tilt-up position, a front end 121 of the cowl 12 is located rearward of an upper end 201 of the bracket 2. When the outboard motor body 3 is located at the full trim-in position, an upper end 122 of the cowl 12 is located below the upper end 201 of the bracket 2. When the outboard motor body 3 is located at the full trim-in position, the tilt shaft 23 is located above a lower edge 123 of the cowl 12. As illustrated in FIG. 9, when the outboard motor body 3 is located at the full trim-in position, a distance L5 between the upper end 122 of the cowl 12 and the tilt shaft 23 in the vertical direction is less than a distance L6 between the tilt shaft 23 and the lower edge 123 of the cowl 12. However, when the outboard motor body 3 is located at the full trim-in position, the distance L5 between the upper end 122 of the cowl 12 and the tilt shaft 23 in the vertical direction may be equal to or greater than the distance L6 between the tilt shaft 23 and the lower edge 123 of the cowl 12.

In the outboard motor 1 according to the present preferred embodiment, the upper connecting pin 26 rotates from the lower limit position 26 (L) to the horizontal position around the tilt shaft 23 at the first rotation angle θ1. The upper connecting pin 26 rotates around the tilt shaft 23 at the second rotation angle θ2 from the horizontal position to the upper limit position 26 (H). The second rotation angle θ2 is larger than the first rotation angle θ1. Therefore, the rotation range from the horizontal position to the upper limit position 26 (H) is larger than the rotation range from the lower limit position 26 (L) to the horizontal position. Therefore, the outboard motor body 3 is substantially tilted up. As a result, the outboard motor body 3 is able to be held at a high position far away from the water surface at the full tilt-up position.

Although preferred embodiments of the present invention have been described above, the present invention is not limited to the above preferred embodiments, and various modifications can be made without departing from the gist of the present invention.

The configuration of the outboard motor 1 is not limited to that of the above preferred embodiments, and may be changed. For example, the drive unit 15 is not limited to the electric motor 17, and may include an internal combustion engine. That is, the outboard motor 1 may rotate the propeller 16 by the driving force of the internal combustion engine instead of the electric motor 17. The internal combustion engine may be located in the cowl 12.

The tilt cylinder 24 is not limited to the hydraulic cylinder, and may be an electric cylinder. The structure of the bracket 2 is not limited to that of the above preferred embodiments, and may be changed. The locations of the tilt shaft 23, the lower connecting pin 27, or the upper connecting pin 26 is not limited to that of the above preferred embodiments, and may be changed.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

a bracket attached to a boat;

an outboard motor body supported by the bracket;

a tilt shaft that rotatably connects the outboard motor body to the bracket;

a tilt cylinder including an upper connector and a lower connector, the tilt cylinder being configured to rotate the outboard motor body around the tilt shaft between a full tilt-up position and a full trim-in position by expanding and contracting;

a lower connecting pin that connects the lower connector to the bracket; and an upper connecting pin that connects the upper connector to the outboard motor body; wherein the upper connecting pin is located at a lower limit position below the tilt shaft when the outboard motor body is located at the full trim-in position;

the upper connecting pin is located at an upper limit position above the tilt shaft when the outboard motor body is located at the full tilt-up position;

the upper connecting pin is configured to rotate from the lower limit position to a horizontal position at a same height as the tilt shaft at a first rotation angle around the tilt shaft;

the upper connecting pin is configured to rotate from the horizontal position to the upper limit position around the tilt shaft at a second rotation angle;

the second rotation angle is larger than the first rotation angle; and in a horizontal direction, a distance between the tilt shaft and the upper limit position is less than a distance between the upper limit position and the lower limit position.

2. The outboard motor according to claim 1, wherein the outboard motor body includes:

a base connected to the bracket;

a cowl located above the base and attached to the base;

a propeller located below the base; and an electric motor located below the base to rotate the propeller.

3. An outboard motor comprising:

a bracket attached to a boat;

an outboard motor body supported by the bracket;

a tilt shaft that rotatably connects the outboard motor body to the bracket;

a tilt cylinder including an upper connector and a lower connector, the tilt cylinder being configured to rotate the outboard motor body around the tilt shaft between a full tilt-up position and a full trim-in position by expanding and contracting;

a lower connecting pin that connects the lower connector to the bracket; and an upper connecting pin that connects the upper connector to the outboard motor body; wherein the upper connecting pin is located at a lower limit position below the tilt shaft when the outboard motor body is located at the full trim-in position;

the upper connecting pin is located at an upper limit position above the tilt shaft when the outboard motor body is located at the full tilt-up position;

the upper connecting pin is configured to rotate from the lower limit position to a horizontal position at a same height as the tilt shaft at a first rotation angle around the tilt shaft;

the upper connecting pin is configured to rotate from the horizontal position to the upper limit position around the tilt shaft at a second rotation angle;

the second rotation angle is larger than the first rotation angle;

the outboard motor body includes:

a base connected to the bracket;

a cowl located above the base and attached to the base;

a propeller located below the base; and an electric motor located below the base to rotate the propeller; and a front end of the cowl is located rearward of an upper end of the bracket when the outboard motor body is located at the full tilt-up position.

4. The outboard motor according to claim 2, wherein an upper end of the cowl is located below an upper end of the bracket when the outboard motor body is located at the full trim-in position.

5. An outboard motor comprising:

a bracket attached to a boat;

an outboard motor body supported by the bracket;

a tilt shaft that rotatably connects the outboard motor body to the bracket;

a tilt cylinder including an upper connector and a lower connector, the tilt cylinder being configured to rotate the outboard motor body around the tilt shaft between a full tilt-up position and a full trim-in position by expanding and contracting;

a lower connecting pin that connects the lower connector to the bracket; and an upper connecting pin that connects the upper connector to the outboard motor body; wherein the upper connecting pin is located at a lower limit position below the tilt shaft when the outboard motor body is located at the full trim-in position;

the upper connecting pin is located at an upper limit position above the tilt shaft when the outboard motor body is located at the full tilt-up position;

the upper connecting pin is configured to rotate from the lower limit position to a horizontal position at a same height as the tilt shaft at a first rotation angle around the tilt shaft;

the upper connecting pin is configured to rotate from the horizontal position to the upper limit position around the tilt shaft at a second rotation angle;

the second rotation angle is larger than the first rotation angle the outboard motor body includes:

a base connected to the bracket;

a cowl located above the base and attached to the base;

a propeller located below the base; and an electric motor located below the base to rotate the propeller; and the tilt shaft is located above a lower edge of the cowl when the outboard motor body is located at the full trim-in position.

6. The outboard motor according to claim 2, wherein, when the outboard motor body is located at the full trim-in position, a distance between an upper end of the cowl and the tilt shaft in a vertical direction is less than a distance between the tilt shaft and a lower edge of the cowl.

7. The outboard motor according to claim 1, wherein the upper limit position is located forward of the lower limit position.

8. The outboard motor according to claim 1, wherein the upper limit position is located rearward of the tilt shaft.

9. The outboard motor according to claim 1, wherein, in a vertical direction, a distance between the tilt shaft and the upper limit position is less than a distance between the upper limit position and the lower limit position.

* * * * *